United States Patent [19]

Segal

[11] Patent Number: 4,842,141

[45] Date of Patent: Jun. 27, 1989

[54] PACKAGE FOR A NUMBER OF PRODUCTS AND METHOD OF USING SAME

[75] Inventor: William J. Segal, Torrance, Calif.

[73] Assignee: Mr. Gasket Company, Cleveland, Ohio

[21] Appl. No.: 176,214

[22] Filed: Mar. 31, 1988

[51] Int. Cl.[4] ..... B65D 75/56

[52] U.S. Cl. ..... 206/462; 53/397; 206/338; 206/471; 206/806

[58] Field of Search ..... 206/338, 461–465, 206/467–471, 493, 526, 806; 53/397

[56] References Cited

U.S. PATENT DOCUMENTS

| | | | |
|---|---|---|---|
| 3,861,528 | 1/1975 | Damuth | 206/463 |
| 3,970,194 | 6/1976 | Iten | 206/469 |
| 4,091,927 | 5/1978 | Lunsford | 206/461 |
| 4,235,336 | 11/1980 | Dudas et al. | 206/462 |
| 4,261,462 | 4/1981 | Wysocki | 206/462 |
| 4,499,353 | 2/1985 | Shields | 206/470 |
| 4,531,636 | 7/1985 | Salacuse | 206/461 |
| 4,619,364 | 10/1986 | Czopor, Jr. | 206/470 |

FOREIGN PATENT DOCUMENTS

| | | | |
|---|---|---|---|
| 0804980 | 1/1969 | Canada | 206/461 |
| 0941255 | 11/1963 | United Kingdom | 206/471 |

*Primary Examiner*—Jimmy G. Foster

*Attorney, Agent, or Firm*—Body, Vickers & Daniels

[57] ABSTRACT

A generally flat, reversible package for shipping and displaying on an hanging fixture in either of two positions a finite number of consumer products which products have a volume defined by given dimensions, such as length, width and height. This package comprises a front generally flat sheet, a back generally flat sheet with the sheet lying in a plane adapted to be vertical when the package is on the fixture, the sheets each have a vertically extending center line dividing the sheets into side-by-side, vertically spaced first and second display segments. A self-sustaining blister container formed from transparent plastic and having a total volume for housing a preselected number of the product to be displayed in side-by-side relationship is provided with means for securing this blister container on the first display segment extending from the flat front sheet a distance generally corresponding to the heights of the products lying in a single layer on the front sheet and in a preselected location and occupying a given area on the first segment of the front sheet, a rear access means, such as an opening through an opaque intermediate sheet, for allowing observation of at least one of the products in the container from the back sheet and having an hanger aperture through the package at a position generally on the aforementioned center line and vertically above the container.

In addition, a method of using this reversible package is provided wherein two packages are nested together when placed upon a cantilever hanging fixture, such as a pegboard arm.

4 Claims, 5 Drawing Sheets

PACKAGE FOR A NUMBER OF PRODUCTS AND METHOD OF USING SAME

The present invention relates to the art of packages and more particularly to a package for a finite number of individual consumer products, such as lug nuts, and the method of using the unique package.

The invention is particularly applicable for shipping and displaying a number of replacement and/or decorative lug nuts such as are commonly employed to fasten vehicle wheels in place on vehicle axles, and it will be described with particular reference thereto; however, it is appreciated that the invention is broader in scope and may apply to various consumer products which have a size generally similar to a lug nut and are sold in a set, including a finite number of such products.

Mass merchandising of lug nuts generally involves a package which maintains a preselected number of lug nuts, as a set, together with a substantial amount of description information indicating which lug nuts are being sold, the type of vehicle using the various sizes and styles, how the lug nuts are to be installed, and related detailed sales information. Such details are even more important with respect to replacement lug nuts which are used on decorative replacement wheels and standard OEM wheels of the type having no wheel covers. Packages for maintaining the lug nuts in sets, for providing sufficient details, and for displaying the lug nuts to the consumer, an essential feature of point of sale marketing, have evolved into a variety of functional configurations. The most common package arrangement includes a blister container for supporting, in individual locations, each of the lug nuts in a side-by side pattern. This blister container has an outer rim which allows the blister container to be extended through a cut out or opening in a paperboard display panel or sheet in a fashion where the displayed set of lug nuts extends outwardly from the sheet. The rim of the container abuts the back side of the paperboard sheet around the periphery of the opening. A second paperboard sheet is glued to the first sheet to hold the blister container in a fixed location with respect to the total package. In this construction, the back sheet can contain substantial sales information regarding the type of lug nuts used on each car and/or information on the particular lug nuts in the package. In addition, the front sheet of paperboard surrounding the blister can contain point-of-sale information attracting the consumer to this particular set of lug nuts. An important feature of such a package is the substantial amount of paperboard material which can contain a substantial amount of descriptive, sales and informational data needed at the point-of-sale and associated with the package for the purposes of expediting mass marketing of lug nuts shipped and displayed by such packages.

Another arrangement for accomplishing this purpose of displaying a set of lug nuts with detailed and substantial sales data involves two plastic sheets, the front one of which has integrally formed therewith an outwardly extending blister for housing the set of lug nuts. A paperboard sheet between the two plastic sheets contains, on the front face, the point-of-sale information necessary to attract a consumer to this particular product and, on the back face, information needed by the consumer in selecting a set of lug nuts and other information necessary for expediting the sale of the lug nuts contained in the package.

In all of these blister packages for individual, finite, side-by-side consumer products, such as lug nuts, several disadvantages exist. These lug nuts are relatively heavy and only a few packages can be mounted on a display fixture involving a number of arms mounted in a cantilever fashion from a support wall, like a pegboard. Each successive package hung on the same cantilever arm exerts a magnified downward torque on the arm at its mounting position on the fixture. In addition, since the packages have an height generally equal to the height of the displayed lug nuts in the package, only a few packages can be mounted on a given cantilever arm, which usually has a length limited to approximately six inches. This short length assures that the torque applied by the support arm to the pegboard because of packages hanging on the arm is restricted. Thus, in many instances, only a few packages, of the type to which this invention is directed, can be supported on each support arm of the fixture. In mass marketing a product, such as a lug nut, it is essential that there be a large variety of lug nuts to accommodate the many vehicles which have been sold. Consequently, a large number of cantilever arms supporting many different lug nuts must be provided on the fixture for the purposes of mass marketing a total line of lug nuts. In view of this situation, it is not unusual to allow only a single arm on a fixture for a single type of lug nut. When shipping lug nuts to the retail outlet in packages heretofore used, a fixed number of packages was packed together in a shipping container or box. This fixed number of packages is often greater than the number of packages which can be mounted on a given arm of a display fixture; therefore, to maintain an adequate supply of packages visible and available to the customers, the stock personnel must continue to replace a few packages on each of the individual display arms. This involves maintaining an inventory of opened containers or boxes since the arms must be restocked before there is a need for a total number of packages contained in the normal supply carton or box shipped from the distributor to the retail outlet. All of these problems make displaying and marketing of a complete line of consumer products, such as lug nuts, quite expensive and requiring not only constant stock maintenance, but also substantial inventory which, in itself, increases cost and increases the propensity for the losing or misplacing of partially filled shipping boxes and pilferage of opened boxes containing lug nuts which have not yet been loaded onto the display fixture.

THE PRESENT INVENTION

The present invention relates to a novel and unique package for consumer products, such as lug nuts, which package overcomes the disadvantages discussed above with respect to mass marketing a total line of consumer products, such as lug nuts, in a fashion requiring display of several such products together with a package visibly displaying the product while containing sufficient paperboard area for point-of-sale marketing as well as data necessary to accommodate the sale of the products.

In accordance with the present invention, there is provided a generally flat reversible package for shipping and displaying, on a hanging fixture such as a pair of pegboard support arms, in either of two positions a finite number (N) of consumer products, each product of which has a circumventing volume with given dimensions of length, width and height. The reversible package for these products, such as lug nuts, comprises a front, generally flat, surface and a back generally flat surface. These surfaces lie in a plane adapted to be generally vertical when the package is placed on the fixture. Each of the surfaces has a vertically extending center line dividing the surfaces into side-by-side, vertically spaced first and second display segments. Means are provided for securing the front and back surfaces together to form the package with a total area. A self-sustaining blister container formed from transparent plastic is secured onto the front surface of the package in what has been referred to as the first display segment. This blister container has an "effective" length greater than N times one of the given dimensions of the product and a total volume to house N products in side-by-side relationship. This blister container can have a top which conforms to the individual products shape or a generally flat top defining a large volume sufficient to display the individual parts in some preselected pattern arranged on the first segment at one side of the center line of the package. This transparent blister container is fixed in a preselected location and occupies a given area of the aforementioned first display segment of the front surface. A cover means of some type, such as a paperboard sheet, is provided for preventing vision through the package over a majority of the total package area. In practice, this cover means is a sheet which covers the total area, except for the opening or cut out from which the container protrudes. On the back surface, this cover means or sheet extends over the total package surface. In accordance with the invention, there is provided a rear access means, in the form of an opening in the sheet forming the cover means, for allowing observation of at least one of the products in the container from a position behind the package. This access is provided by a hole in the cover means or sheet exposing one of the lug nuts or other product in the container on the front of the package.

The novel package includes a blister occupying a position on the front surface and on one side of the center line. The rear access means or opening allows viewing one or more of the parts from the back of the package; therefore, in accordance with another aspect of the invention, a method of using this novel package is provided. The package has two hanger engaging slots centered on each of the side-by-side display segments with the center of the slot over the lug nut container generally aligned with the center of gravity of the contents of the container. This novel display method involves the steps of nesting two of the novel packages with the front surfaces facing each other so that the protruding blister, or transparent plastic container, of each package is located on opposite sides of the center line of the facing packages with the slots still aligned. The packages can thus be placed in parallel relationship with nesting at the front surface. By providing a novel rear access means, the product can be viewed from the back surface so that a consumer still realizes and appreciates the visual aspects of the product being sold. The method involves use of two support arms spaced horizontally to extend into the two slots of the nested packages.

By using this package as discussed above, the product packages can be nested and shipped in the nested condition so that the total stack height is about one-half of the height of the products times the number of packages being shipped. In the past, the stack height was essentially the number of packages times the height of the individual lug nuts being shipped. By providing this novel reversible package with the nesting arrangement, twice as many packages can be mounted on the cantilever arms of a display fixture for selling several sizes and types of a total product line, such as a line of lug nuts. By using the present invention, the stocking personnel at the retail outlet can allow the packages on the display fixture to be depleted until a complete box of six nested lug nut packages is needed to fill the set of arms. These six packages can be removed from the shipping carton or box and placed on the arms, as a group, in the nested condition used to ship the packages. Thus, it is not necessary to break a shipping carton or box to load a few packages of a particular lug nut size or type onto the cantilever display arm, leaving the remainder of the packages in the shipping box for pilferage, damages or loss.

By using the present invention, the height of stack of packages being shipped and/or displayed is reduced by nearly 50%. This increases the efficiency of bulk shipment and reduces the complexity of merchandising at the retail outlet.

The primary object of the present invention is the provision of a package for selling a set of discrete products, which products require both visual display of the products and detailed sales information, such as sets of replacement and/or decorative lug nuts, where lug nuts fitting many automobiles must be displayed together, which package increases the efficiency of shipment, decreases the inventory problems, and allows more efficient and economical stocking and displaying of the products in the package at the point-of-sale.

Another object of the invention is the provision of a package, as defined above, which package can be manufactured at essentially the same cost of existing packages for this same type product and still results in the advantages discussed above.

Yet another object of the present invention is the provision of a package, including two sheets with a blister container on one sheet, referred to as the "front" sheet, and an opening or access to view at least one of the products from the other, or "back" sheet.

These and other objects and advantages will become apparent from the description utilizing the drawings described in the next section.

PREFERRED EMBODIMENT

Figure 1:
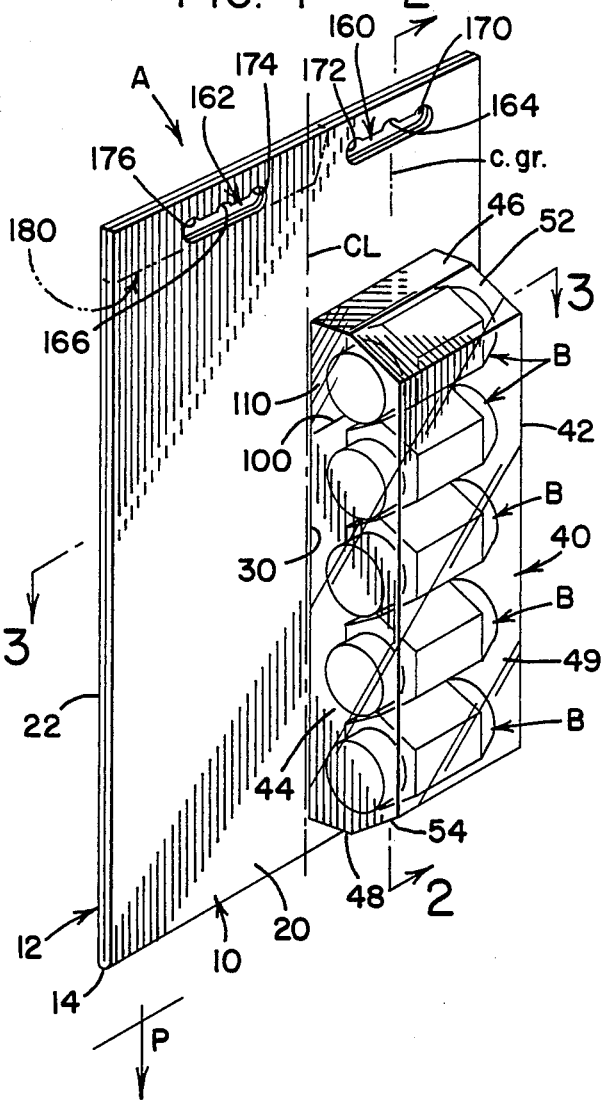
FIG. 1 is a pictorial view showing the preferred embodiment of the present invention.
Figure 2:
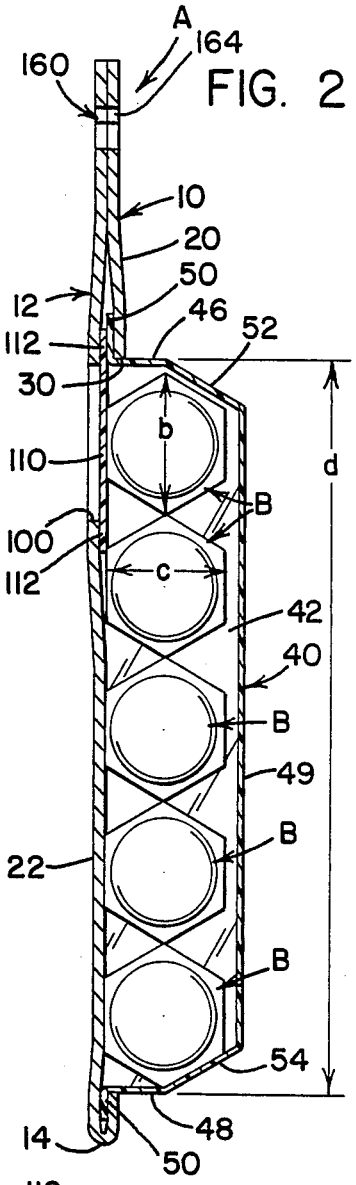
FIG. 2 is an enlarged cross-sectional view taken generally along line 2—2 of FIG. 1.
Figure 3:
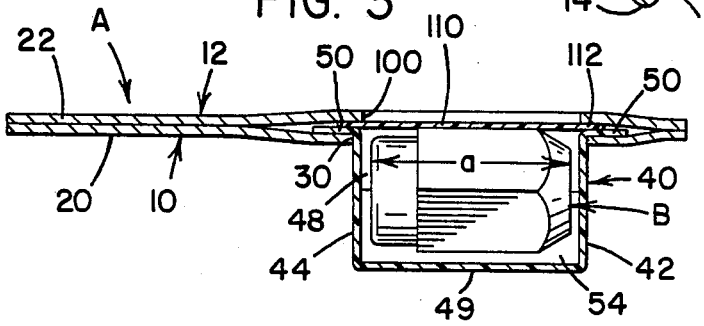
FIG. 3 is an enlarged cross-sectional view taken generally along line 3—3 of FIG. 1.

Referring now to the drawings wherein the showings are for the purpose of illustrating preferred embodiments of the invention only and not for the purpose of limiting same, FIGS. 1–4 show a package A for shipping and displaying a finite number (N), illustrated as N=5, of consumer products, such as lug nuts B sold in sets of four or five and each having its own circumventing volume. This volume is for definition purposes only and is used to indicate the general space occupied by each of the nuts B. This hypothetical volume has a length a for the lug nut B as illustrated in FIG. 3. In practice length a is in the range of 1.0–2.0 inches. The width b of the circumventing volume is the width of lug nut B as shown in FIG. 2. This dimension is in the general range of 0.5–1.0 inches. The height c of the volume is the height of the lug nut which is generally the same as the width b. The lug nuts are generally symmetric polygons of hexagonal shape in cross-section as viewed from the end as shown in FIG. 2. Each of the individual lug nuts B occupies a preselected space defined as the circumventing volume and are displayed in side-by side relationship as best shown in FIG. 1. This type of product is sold on a pegboard or display fixture C by mounting several packages onto two cantilever arms D having, in practice, a length of approximately 6.0–8.0 inches and extending through openings or slots 160, 162 in package A.

Figure 4:
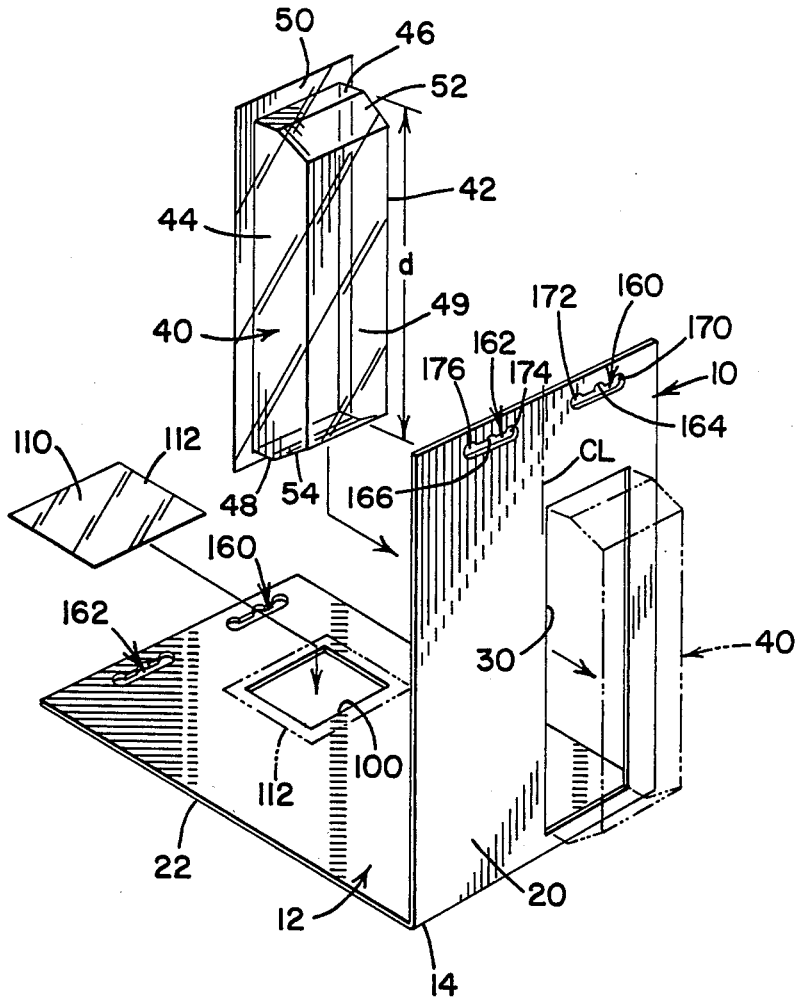
FIG. 4 is an exploded pictorial view showing the assembly of components to produce the package illustrated in FIGS. 1–3.

Package A includes a front paperboard sheet 10 and a back paperboard sheet 12 bent from a single blank by folding along edge 14 and adhered together to form the package A. Front surface 20 of sheet 10 and back surface 22 of sheet 12 are provided with the necessary point of sale information and data necessary for identifying the particular lug nut set to be used and instructions regarding the use. Package A includes, for the purpose of defining the invention, a center line CL extending vertically midway between openings or slots 160, 162 and dividing front surface 20 into a first display segment to the right of the center line and a second display segment to the left of the center line. This center line is a construction line to explain that the lug nuts B, when in the package, are located on surface 20 at one side of the center line, i.e. they are mounted on the first display segment of surface 20 or sheet 10. The center line also divides surface 22 into a first display segment and a second display segment matching the first and second segments of front surface 20 when the sheets are bent along edge 14 and adhered together to assemble the sheets 10, 12 into package A. The sheets and, thus package A extends generally along plane P, as shown in FIG. 1. This plane is generally vertical in orientation and is orthogonal to the center line of mounting arms D extending outwardly from pegboard or support wall C. Sheet 10 is provided with an opening or cut out 30 in the first display segment at the right side of center line CL, as shown in FIGS. 1 and 4. This opening has a shape to receive a transparent, or clear plastic, blister container 40 having parallel side walls 42, 44 and parallel end walls 46, 48 spaced apart a distance d, referred to as "effective length" of the container. Container 40 receives a selected number, N, of individual lug nuts B as shown in FIGS. 1 and 2. N equals 5 in the illustrated embodiment. The effective length d is selected to accommodate the number of lug nuts displayed at front surface 20 by container 40. Of course, the container could have an outer profile matching the individual lug nuts; however, in the preferred embodiment the container has a generally flat top wall 49 parallel to surface 20 and is generally rectangular in configuration. Each end of the container is tapered by inclined walls 52, 54. As so far described, package A supports a fixed number of lug nuts B in container 40 extending through opening 30. This container has an outer peripheral flange 50 larger in dimension than opening 30 to provide a border around opening 30 for supporting the container in the fixed relationship extending outwardly from surface 20 a distance generally matching the height c of the individual lug nuts B.

After blister container 40 is loaded with lug nuts B, back sheet 12 is folded along edge 14 to close the back of the container 40, thus capturing the lug nuts in package A. In accordance with an aspect of the invention, back sheet 12 has a means for viewing a lug nut in container 40 from behind the package. This means is an opening 100 with a size generally matching the rear projected profile of a single lug nut B and is aligned with one of the lug nuts B when sheets 10 and 12 are adhered to each other in vertical plane P. Clear plastic blank 110 is larger than opening 100 to provide an outwardly extending support area or flange 112 for securing the clear or transparent plastic blank 110 over opening 100. In this way, one of the products i.e. a lug nut, in container 40 can be seen from back surface 22. Consequently, package A is reversible. The displayed products can be viewed from either front surface 20 or from the back surface 22 at the point-of-sale. Irrespective of the orientation on cantilever arms D, the actual product is visible to the consumer passing by the support wall or pegboard C in the retail outlet.

Figure 5:
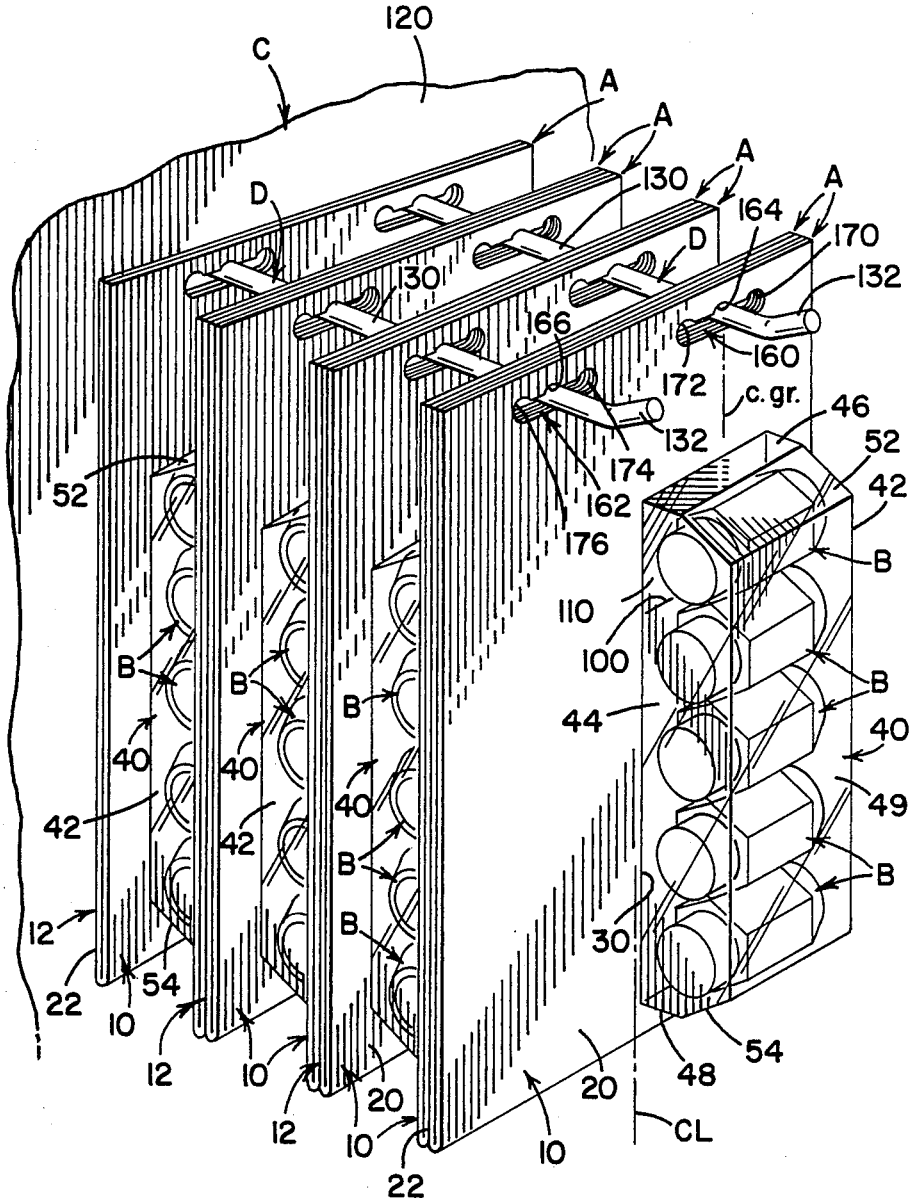
FIG. 5 is an enlarged pictorial view illustrating several packages constructed in accordance with the present invention mounted on a display fixture in accordance with a feature of the present invention.
Figure 6:
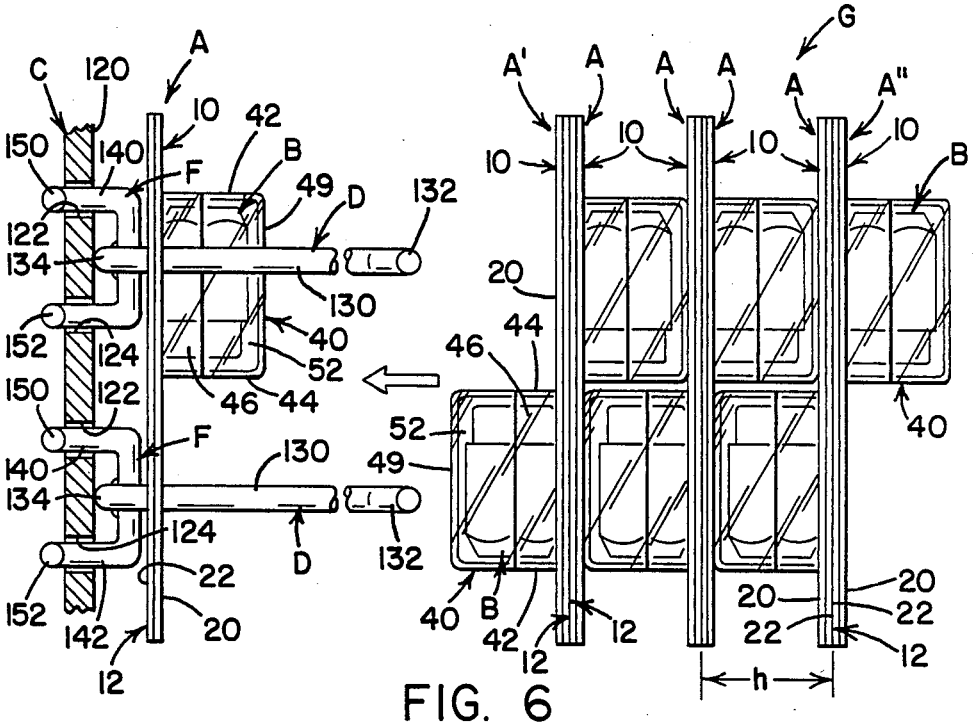
FIG. 6 is a view generally from the top of FIG. 5 illustrating the display fixture after several packages have been sold and including a stack of packages for restocking the display fixture.
Figure 7:
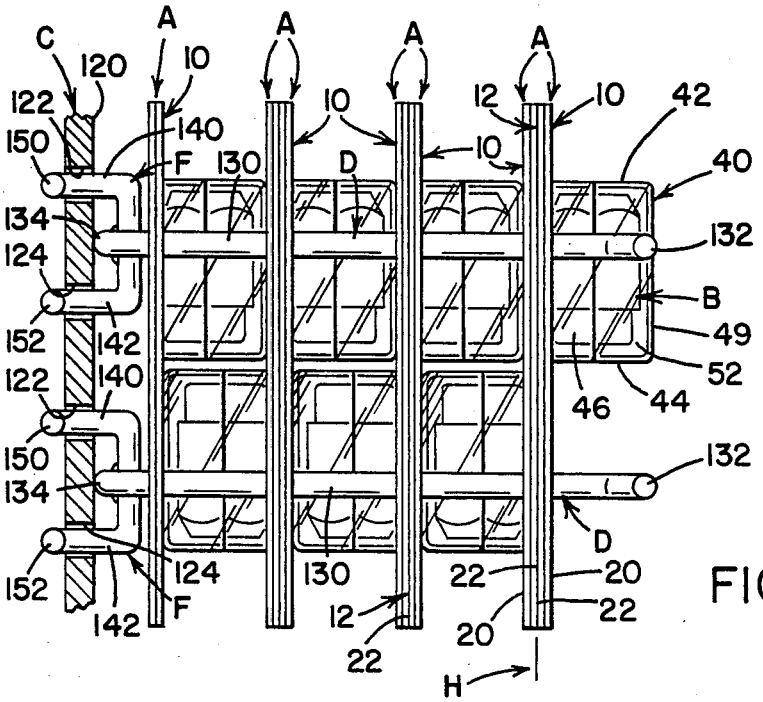
FIG. 7 is a view similar to FIG. 6 illustrating the display fixture after the packages have been moved as indicated by the arrow in FIG. 6 to the display fixture.

By providing the package A with the novel features so far described, the package is reversible and can be used in accordance with a novel method, best explained in relationship to FIGS. 5–7. Two packages A can be nested together by bringing the packages into parallel alignment with the respective front sheets 10 facing each other, as shown in FIGS. 6–7. In this manner, the packages nest together with openings 160, 162 alternately aligned. Nested packages with opening or slot 160 of one package over opening or slot 162 of the adjacent package, and vice versa, can be shipped and assembled onto arms D for the purpose of display. Two nested packages have an overall stack height h of about one-half the height of two packages heretofore used in distributing lug nuts. This is shown in FIG. 6. Generally six packages of each type lug is shipped in a single box or container. This carton has a height of approximately three inches in accordance with the present invention and six inches in accordance with use of the prior type packaging. A pack is illustrated as the group G of packages A at the right of FIG. 6. This figure depicts a pegboard C having a front exposed surface 120 and many sets of horizontally spaced generally cylindrical support holes 122, 124. Each arm D includes an outwardly extending support 130 with an outboard, upwardly inclined stop 132. A short downwardly extending bar 134 engages surface 120. A welded U-shaped bracket F has arms 140, 142 extending through holes 122, 124, respectively. Rear bars 150, 152 extend vertically a short distance upwardly as shown along the back of pegboard C.

When the relatively compact set of six packages are removed from the shipping carton or box and placed upon arms D, they fit closely adjacent the rear support wall of pegboard C so that a large number of packages can be displayed. This is shown as the six packages to the left of line H in FIG. 7. This is made possible by the orientation of the blister container 40 on front surface 20, as well as the rear access opening 100 allowing visual exposure of one lug nut B from rear surface 12. Irrespective of the arrangement of the package on cantilever arms D, the product, or lug nut B, can be viewed. In addition, substantial surface is provided for advertising material on surface 20, except for cut out or opening 30. A substantial amount of detailed information can also be provided on the exposed portion of back surface 22 except for the opening or cut out 100.

Referring again to FIG. 6, group G is employed for the purpose of restocking the particular lug nut B when a single package A remains on horizontally spaced cantilever arms D as shown at the left of FIG. 6. After the six packages have been removed from the carton, the package on the right labeled package A' is moved from its right nested position to the left position so that the forwardly protruding blister or container 40 is oriented to nest with the remaining package A on arms D. Then the group G is moved in unison as indicated by the arrow in FIG. 6 to the nested position shown in FIG. 7. In this manner, when a single package remains, a total of six nested packages can be assembled onto pegboard for the purpose of reloading the depleted supply of products for display and sale. The unnested package A' leaves its companion package A" exposed in carton 40 extending outwardly as shown in FIGS. 6 and 7. When this carton is sold, the customer will see a back sheet 12 in the next package and can view only a single lug nut through rear access means 100 previously mentioned. When that package is sold, then a full group of lug nuts will be exposed. Of course, since many lug nuts are displayed at the same time on pegboard C, some of the packages will undoubtedly have their front face exposed while the others have their back face exposed. This will give a complete picture so that a consumer knows exactly what lug nuts are available. By this nesting arrangement, about twice as many packages can be mounted on a pegboard. This provides a lesser downward torque on cantilever arms D since torque 1s measured by both weight and distance from support surface 120. As illustrated in FIG. 1, the openings or slots 160, 162 are provided with upwardly extending indentations 164, 166, respectively. In this manner, arms D nest in the respective indentations 164, 166 for viewing the products irrespective of the orientation of the package. As shown in FIGS. 5–7, for the slots 160, 162 and their indentations 164, 166 to fit on the two support arms 130 of the fixture C in either of the reversible nested positions of the packages A thereon, they must be located the same distance and thus symmetric with the center line CL of the package A. In accordance with the illustrated embodiment, openings or slots 160, 162 also include outwardly faced indentations 170, 172 and 174, 176 for the purpose of accommodating certain cantilever arms which include two outwardly extending support bars 130. Slot 160 is generally aligned with the center of gravity (c.gr.) of the loaded package so that the weight of the lug nuts B of the package is generally directly downward from indentation 164 for balancing purposes. By employing the novel reversible package in accordance with the present invention, a novel method is provided for shipping, storing and displaying a total line of products such as lug nuts which require a large variety of types and sizes to be displayed in separate groups to accommodate the desires and vicissitudes of the customer demands.

Since the weight of package A is concentrated in the display segment to the right of center line CL, slot 160 can support package A in a vertically upright position. Consequently, it is possible to eliminate slot or opening 162 as long as clearance is provided in this area for the second cantilever arm D. This concept is illustrated in FIG. 1 wherein the phantom line 180 illustrates the section of the package to the left of the center line being removed so that the package is supported completely by arm D extending through slot 160. This modification is mentioned only for the purposes of delineating the scope of the invention although it is preferred to provide the two slots 160, 162 as illustrated in the embodiments of the invention.

Figures 8, 9:
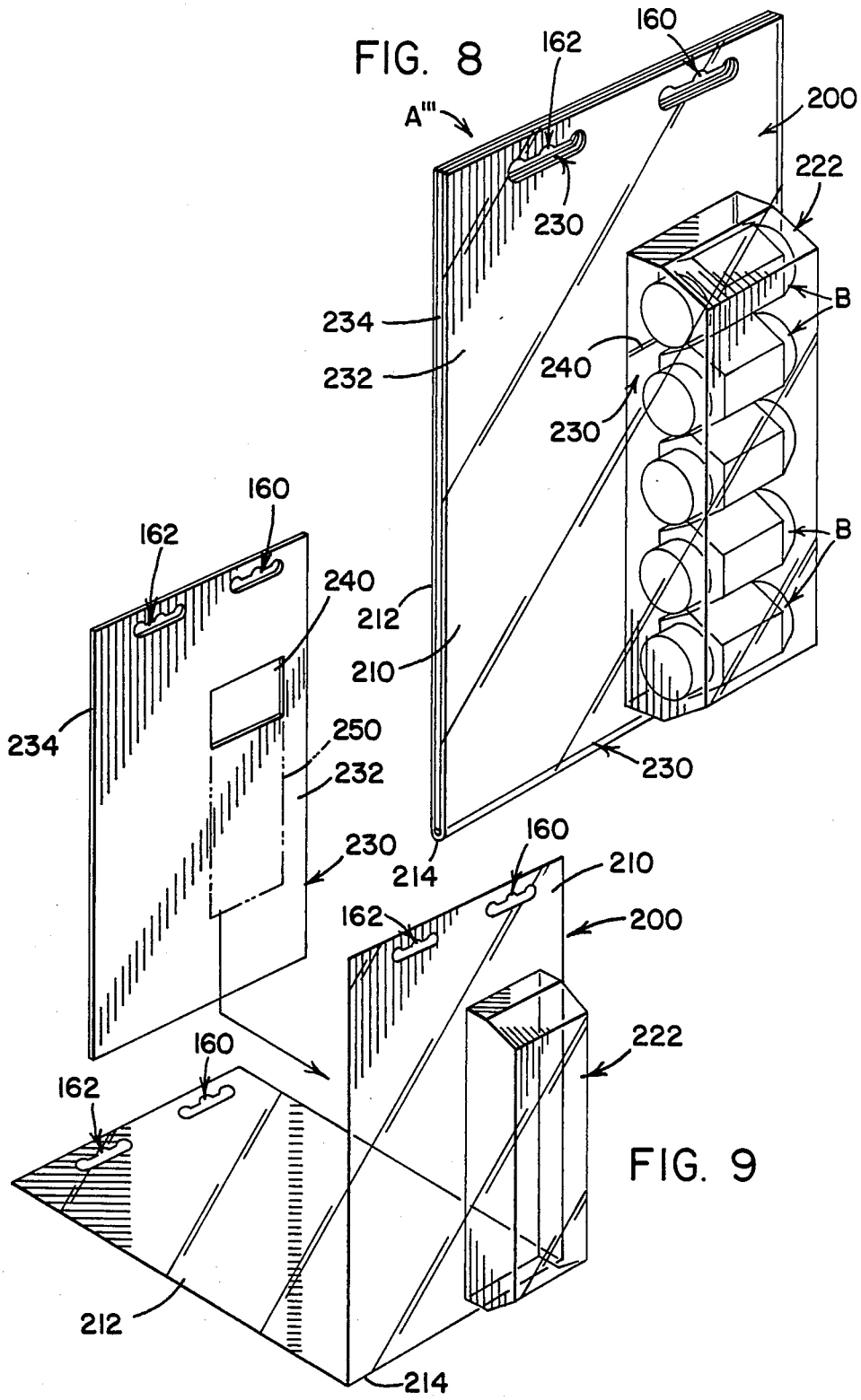
FIG. 8 is a pictorial view similar to FIG. 1 illustrating a modification of the present invention; and, FIG. 9 is a view similar to FIG. 4 showing construction components constituting the modification illustrated in FIG. 8.

A modification of the preferred embodiment of the invention is illustrated in FIG. 9 wherein a reversible package A', constructed in accordance with the present invention, is formed by plastic sheet 200 formed from a transparent or clear plastic material and including a front section 210 and a back section 212 joined at lower folding edge 214. In accordance with this modification, blister container 222 is integrally formed with front section 210 of plastic sheet 200 to perform the functions ascribed to container 40 in the preferred package A. Sales information and sales data for package A' is printed on paperboard blank, or sheet 230 having front surface 232 and back surface 234. The rear access means for viewing a single lug from the back side or surface 234 is a cut out or opening 240 in paperboard blank 230 which is aligned with a single lug nut B in the forwardly facing, integral blister container 222. With the printed paperboard blank or sheet 230 placed between sections 210, 212, these sections are brought together and adhered either with an adhesive or by heat sealing. By constructing sheet 230 smaller than sections 210, 212 a border remains around the paperboard blank when it is sandwiched between the plastic sheets. Thus, an heat sealable outer rim remains around the paperboard blank.

In accordance with a modification of the invention, the opening or cut out 240 could be extended, as indicated by the phantom 250, to provide rear visual access to more than one lug nut B. As a further modification, it would be possible to provide a paperboard front surface or sheet, as used in the preferred embodiment illustrated in FIGS. 1–4, and a clear plastic back sheet. This arrangement would expose all lug nuts from the back surface of the package, since container 40 of package A would be closed only by a plastic sheet. It is preferred that only a single lug nut be viewed from the back to accommodate the need for a substantial amount of printed information on the back of the package. In this fashion, the consumer can view the actual product, if either the back surface or the front surface is exposed.

When the packages are nested in accordance with the present invention, after a package has been removed, the next package has the opposite surface facing the consumer. Each surface can contain sales concepts to attract a consumer, while obtaining the benefit of each position on pegboard or display fixture C accommodating essentially twice as many packages. Thus, when one or two packages are on the arms D a full box of nested packages can be unpacked and loaded onto the display arms D. In the past, even when all the packages had been removed, it was difficult to load a full stack of new packages.

Having thus described the invention, the following is claimed:

1. A method of displaying several packages of consumer products on a single cantilever hang fixture having a pair of parallel spaced support arms extending form a support wall horizontally outwardly, said method comprising the steps of:

(a) providing a generally flat reversible package comprising a front sheet and a back sheet adhered together back-to-back to form a composite, substantially planar display panel having a generally flat front surface and a generally flat back surface, said display panel lying in a plane adapted to be vertical when said package is hung on the said fixture, said front surface having a vertically extending center line dividing said front surface into side-by-side first and second display segments, a self-sustaining blister container formed from transparent plastic, said blister container having a total volume for housing N products in side-by-side relationship and secured on said first display segment extending from said front surface a distance generally corresponding to said height of one of said products and occupying a given area of said first segment, rear vision access means for allowing observation of at least one of said products in said container from said back surface, and a hanging aperture formed at the top of said package, generally at the center of gravity of the loaded said package;

(b) placing a first of said packages on said fixture with said front surface facing away from said support wall;

(c) placing a second of said packages on said fixture with said front surface facing toward said support wall to nest with said first package; and, (d) continuing said steps (b) and (c) to produce a number of nested first and second packages on said cantilever fixture.

2. A generally flat reversible package for shipping and displaying, in either of two reversed positions of the package on a hang fixture having a pair of horizontally extending and spaced apart parallel support arms, a finite number (N) of like consumer products each having a circumventing volume with the same given dimensions of length, width and height, said package comprising a front sheet and a back sheet adhered together back-to-back to form a composite, substantially planar display panel having a generally flat front surface and a generally flat back surface, said display panel lying in a plane adapted to be vertical when said package is hung on said fixture, said front surface having a vertically extending center line dividing said front surface into side-by-side first and second display segments, a self-sustaining blister container formed from transparent plastic, said blister container having a total volume for housing N products in side-by-side relationship, means securing said blister container on said display panel in a position extending outwardly from the said front surface thereof and located entirely within the profile of said first display segment and projecting outwardly from the said front surface on said display panel a distance generally corresponding to said height of said circumventing volume of each respective one of said products, rear vision access means for allowing observation of at least one of said products in said container from said back surface, and a pair of hang apertures through said package at a position generally vertically above said container and located within respective ones of said first and second display segments, with the one of said hang apertures located within said first display segment being vertically aligned with the center of gravity of the loaded package and the two said hang apertures being horizontally spaced apart a distance matching the spacing of said pair of support arms and symmetrically located with respect to the said center line of said package.

3. A generally flat reversible package for shipping and displaying on a hang fixture in either of two reversed positions a finite number (N) of consumer products each of which has a circumventing volume with given dimensions of length, width and height, said package comprising a front sheet and a back sheet adhered together back-to-back to form a composite, substantially planar, display panel having a generally flat front surface and a generally flat back surface, said display panel lying in a plane adapted to be vertical when said package is hung on said fixture, said surfaces each having a vertically extending center line dividing said surfaces into side-by-side, horizontally spaced, first and second display segments, a self-sustaining blister container formed from transparent plastic, said blister container having a total volume for housing N products in side-by-side relationship, means for securing said blister container on said first display segment of said front surface extending therefrom a distance generally corresponding to said height of said circumventing volume of each respective said products in a preselected location and occupying a given area of said first segment, rear vision access means for allowing observation of at least one of said products in said container from said back surface, said package including an upper portion above said container and said products of said package defining a center of gravity of said package when loaded with said products, and said package including a hang aperture opening means for allowing passage of one of a pair of horizontally parallel, spaced support arms of said hang fixture through said package generally orthogonal to said plane, said opening means being at said upper portion and vertically aligned with the center of gravity of said loaded package, and clearance means allowing passage of said other of said pair of support arms through said plane of said package when said first mentioned support arm is through said opening means.

4. A package as defined in claim 3 wherein said clearance means is a second hang aperture opening means spaced from said first mentioned hang aperture opening means a distance matching the spacing of said pair of support arms and with both of said hang aperture opening means being symmetric with said center line of said package.

* * * * *